United States Patent [19]

Reichlin

[11] 4,069,546

[45] Jan. 24, 1978

[54] SOFFIT PLATE AND LIMIT STOP FOR USE WITH HYDRAULIC DOOR CLOSER

[75] Inventor: Stanley B. Reichlin, Wynnewood, Pa.

[73] Assignee: Reading Door Closer Corporation, Reamstown, Pa.

[21] Appl. No.: 601,422

[22] Filed: Aug. 4, 1975

[51] Int. Cl.[2] ..... E05F 5/08

[52] U.S. Cl. ..... 16/85

[58] Field of Search ..... 16/49, 59, 61, 62, 63, 16/64, 65, 69, 70, 72, 73, 74, 75, 78, 79, 80, 82, 85, DIG. 10, DIG. 36

[56] References Cited

U.S. PATENT DOCUMENTS

| | | | |
|---|---|---|---|
| 926,520 | 6/1909 | Thornton et al. | 16/49 X |
| 1,024,465 | 4/1912 | Voight | 16/49 |
| 2,584,404 | 2/1952 | Webb | 16/72 UX |
| 2,797,117 | 6/1957 | Seay et al. | 16/72 X |
| 3,259,936 | 7/1966 | Sheridan | 16/49 |
| 3,331,160 | 7/1967 | Eckel | 16/72 X |

FOREIGN PATENT DOCUMENTS

| | | | |
|---|---|---|---|
| 421,197 | 5/1947 | Italy | 16/80 |
| 659,412 | 10/1951 | United Kingdom | 16/73 |

*Primary Examiner*—Werner H. Schroeder
*Assistant Examiner*—Moshe I. Cohen
*Attorney, Agent, or Firm*—Robert C. Podwil

[57] ABSTRACT

A resilient element coupled to a soffit plate provides a means for first resiliently and then non-resiliently limiting movement of a control arm associated with a hydraulic door closer, to thereby cushion and limit movement of a door to its extreme open position.

9 Claims, 5 Drawing Figures

FIG. 1
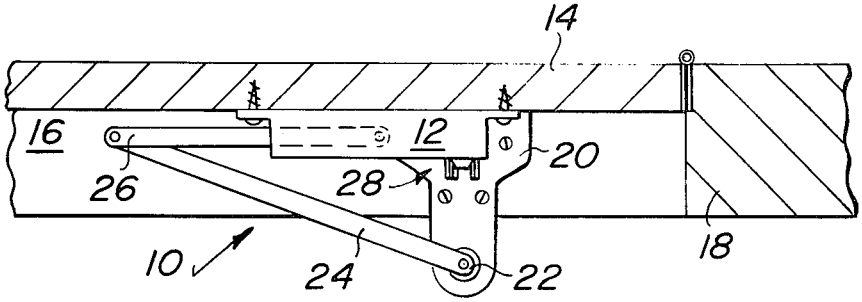
FIG. 5
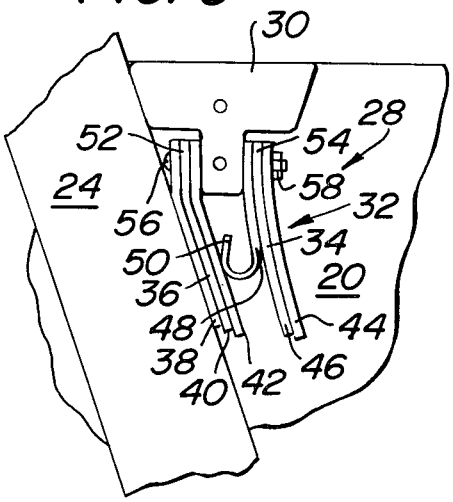
FIG. 2
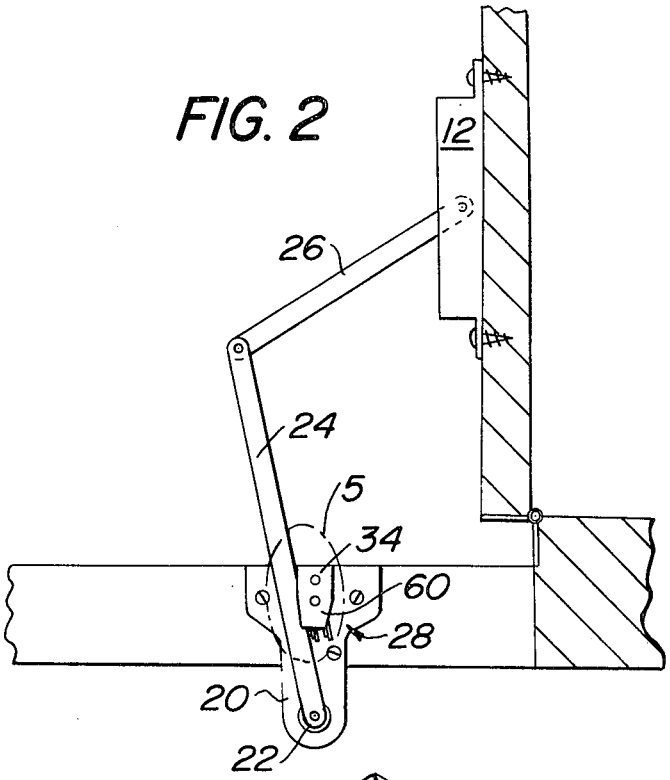
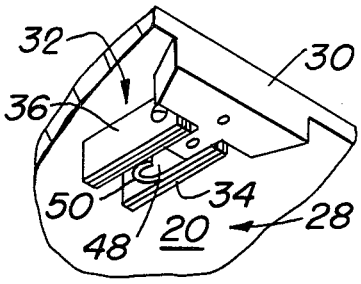
FIG. 3
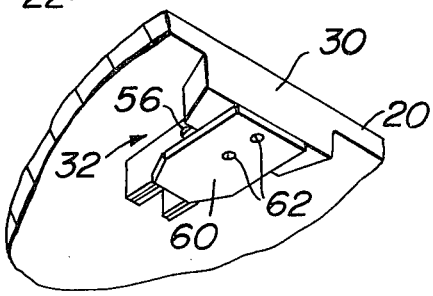
FIG. 4

SOFFIT PLATE AND LIMIT STOP FOR USE WITH HYDRAULIC DOOR CLOSER

This invention relates to a soffit plate and limit stop, and more particularly, to a soffit plate and limit stop intended for use with a hydraulic door closer.

Hydraulic door closers such as those illustrated in U.S. Pat. Nos. 3,082,471 to Rolph, issued Mar. 26, 1963, and 3,259,936, to Sheridan, issued July 12, 1966, are of the general type to which this invention relates. Such door closers utilize a spring-urged hydraulic piston to bias a door to its closed position, and also provide a hydraulic back-check to smoothly retard and cushion movement of the door as it approaches its extreme open position. Typically, the force generated by the door closer unit is transmitted between the unit and fixed structure such as the door frame through a linkage, generally consisting of the pair of links, pivotably coupled to the unit and to a soffit plate mounted on the door frame.

Because the internal mechanism of closer units is hydraulic, the ability of a unit to cushion back-check forces is determined by, among other factors, the configuration of its hydraulic system, and the spring characteristics and hydraulics control the return movement of the piston, and the characteristics of the back-check valve. A shortcoming of many commercially available units is an inability to provide an effective back-check in situations in which the door is first permitted to swing closed through a small arc, and then immediately returned to its extreme open position. Such a situation may exist, for example, when a file of people passes through the doorway. In such instances the repeated rapid movement of the door to its extreme open position is often unchecked or only partly checked by the back-check feature of the unit, and severe stresses on the door control linkage and on the soffit plate may result, sometimes to the point of causing damage to the soffit plate and linkage.

Attempts have been made to deal with the above-mentioned general problem. For example, in accordance with U.S. Pat. No. 1,024,465, to Voight, issued Apr. 23, 1912, a specially constructed mounting member is provided for the door closer itself (not on a soffit plate), and a spring-urged plunger is provided to cushion movement of a lever arm. In the above-mentioned U.S. Pat. No. 3,259,936, a "snubber" is provided, which utilizes a spring-urged slide as one pivot point for a control arm, the slide itself being movable in response to tension on the arm when the door approaches its extreme open position.

It is a principal object of this invention to provide, for use in combination with a door closer, a simple and effective limit stop device associated with a soffit plate of otherwise conventional construction. It is another object to provide a limit stop device which is both durable and mechanically simple, and which employs the barest minimum of parts subject to wear. The foregoing and other objects of this invention are realized, in a presently preferred form, by a soffit plate-mounted limit stop comprising a dead stop member, disposed in the path of movement of an arm interconnecting a door and a door closer, and a spring member, of the leaf spring type in the illustrated embodiment, disposed in the path of movement of the arm and positioned to be contacted by the arm before the arm engages the dead stop member. Thus, as the arm approaches the dead stop member, the spring member is deformed to resiliently limit movement of the door in the last few degrees of its travel. Deformation of the spring member ultimately permits the arm to abut the dead stop member, to provide a non-resilient limit stop defining the extreme open position of the door.

For the purpose of illustrating the invention, there is shown in the drawings a form of the invention which is presently preferred, it being understood, however, that this invention is not limited to the precise arrangements and instrumentalities shown.

FIG. 1 is a view, looking upwardly, showing the general arrangement of a door closer, soffit plate and limit stop in accordance with the present invention.

FIG. 2 is a view, from the same vantage point as in FIG. 1, showing operation of the apparatus.

FIG. 3 is a partial perspective view, showing a limit stop in accordance with the present invention.

FIG. 4 is a view generally similar to that of FIG. 3, but showing in exploded fashion further details of the limit stop in accordance with the present invention.

FIG. 5 is a detail view of a portion of FIG. 2, showing operation of a limit stop in accordance with the invention.

Referring now to the drawings in detail, wherein like numerals indicate like elements, there is seen in FIG. 1 apparatus designated generally by the reference numeral 10. The apparatus 10 comprises a hydraulic door closer unit 12 of conventional construction affixed to a door 14.

Affixed to a lintel 16 of the door frame 18 with which the door 14 is associated, is a soffit plate, designated generally by the reference numeral 20. The soffit plate 20 has, at a projecting end thereof, a pivot point 22, to which is secured a control arm 24. The control arm 24 is pivoted at the end remote from the pivot point 22 to an end of a control arm 26 associated with the door closer unit 12.

The function of the door closer unit 12, it will be understood, is to return the door 14 to its closed position after opening, and additionally, to provide a back-check, that is, a buffer action when the door 14 approaches its extreme open position. The limitations of hydraulic circuitry and spring rates in conventional door closer units 12 are such that the back-check feature is usually unable to cope with a succession of quickly repeated partial closings and reopenings. In such instances the back-check mechanism does not recover sufficiently quickly to check each repeated movement of the door 14, and as a result, the door 14, if not otherwise controlled, may forcefully and abruptly engage its stop (if any) or encounter the limit of travel permitted by its linkage.

Referring now to FIGS. 2, 4 and 5, there is seen in detail a limit stop, designated generally by the reference numeral 28, in accordance with the present invention. The limit stop 28 includes a fixed dead stop member 30 affixed to the soffit plate 20. The dead stop member 30 provides an absolute limit to movement of the control arm 24, and, therefore, also the door 14. Affixed to the dead stop member 30 are spring means, designated generally by the reference numeral 32. The spring means 32 in the illustrated embodiment are perhaps best seen in FIGS. 3 and 5, and comprises a pair of multiple leaf springs 34 and 36, made up of sets of individual leaf spring elements 38, 40, 42 and 44, 46 and 48, respectively. In the illustrated form of the invention, the element 48 is shaped so as to form a finger-like projection 50, extending into engagement or near engagement with the element 42. The projection 50 serves to operatively interconnect the respective multiple leaf springs 34 and 36 so that forces applied by a control arm 24 to one of them are transmitted to the other, and resisted by both. First end portions 52 and 54 on the leaf springs 36 and 38 are affixed to the dead stop member 30 by means such as the bolt 56 and nut 58 seen in FIGS. 4 and 5. The other end portions of the leaf springs 34 and 36 extend away from the dead stop member 30 for a purpose which will now be explained.

It should be apparent from FIGS. 2 and 5 that as the control arm 24 approaches the dead stop member 30 in the course of its movement, it contacts the spring means 32, and initially deforms the leaf spring 36. The effect of such deformation is to cause the end portions of the leaf spring elements 38–42 to slide with respect to each other as is characteristic of multiple leaf springs, and to partly or fully absorb the impact of the control arm 24. Deformation of the leaf spring 36 also brings the projection 50 into force-transmitting contact with the leaf spring element 42, which results in deformation of the end portions of the leaf spring elements 44–48. Ultimately, the spring means 32 may reach a configuration like that shown in FIG. 5, wherein it is fully deflected and the control arm 24 abuts the dead stop member 30. Thus, if the force applied by the control arm 24 is sufficiently strong the spring means 32 and the dead stop member 30 provide, in effect, first resilient and then non-resilient resistance to movement of the control arm 24.

The resilience of the spring means 32 is such, however, that it can recover virtually instantaneously from its fully deformed condition, so that rapid repetitive opening movements of the door are effectively cushioned by the action of the limit stop 28.

In the illustrated form of the invention, a cover plate 60 is provided for the dead stop member 30, to protect the spring means 32 and enhance the appearance of the device. Thus, with reference to FIG. 4, the cover plate 60 may be affixed to the dead stop member 30 by means of machine screws 62 or their equivalents.

For assembly of the limit stop 28, all that need be done is to affix to the soffit plate 20 the leaf spring means 32. The single bolt 56 and nut 58 can serve this purpose. Openings, not shown, may be provided in the ends of the leaf spring elements 38–42 and 44–46 and in the dead stop member 30 to receive the bolt 56. The simplicity of the structure makes maintenance or replacement of parts a simple matter.

It should also be apparent from the foregoing that the present limit stop 28 is non-directional, in the sense that it can accommodate without modification variations in the control arm linkage in which the control arm approaches the dead stop member 30 from either side.

The present invention may be embodied in other specific forms without departing from its spirit or essential attributes, and, accordingly, reference should be made to the appended claims rather than the foregoing specification, as indicating the scope of the invention.

I claim:

1. For use in combination with a door, a door closer and at least one arm operatively interconnecting said door and said door closer, a soffit plate having thereon a pivot point for said arm and a limit stop adapted to contact said arm to first resiliently and then nonresiliently limit movement of said door, said limit stop being spaced from said pivot point and comprising a dead stop member disposed in the path of movement of said arm and defining a limit position of the door, and spring means disposed in the path of movement of said arm, said spring means comprising a leaf spring having a first portion thereof coupled to said soffit plate adjacent to said dead stop member and another portion thereof remote from said first portion and said dead stop member, said arm engaging and deforming said other portion when said arm approaches a position corresponding to a limit position of the door, said spring means being so positioned with respect to said arm and said dead stop member that deformation of said leaf spring permits said arm to engage said dead stop member when said arm reaches a position corresponding to a limit position of the door.

2. Apparatus in accordance with claim 1, wherein said leaf spring is operatively associated with two sides of said dead stop member, so that said limit stop is effective with respect to arms whose paths of movement approach the said limit stop from either of said sides.

3. Apparatus in accordance with claim 2, wherein said leaf spring comprises a plurality of individual spring elements disposed on each of said sides of said dead stop member and in stacked relation with respect to each other to define a pair of multiple leaf springs, portions of said elements being slidable with respect to each other upon deformation of said multiple leaf springs.

4. Apparatus in accordance with claim 3, and means operatively interconnecting said pair of multiple leaf springs to transmit forces from one of said pair to the other.

5. Apparatus in accordance with claim 4, wherein said last-mentioned means comprises a spring element of one of said pair having a portion thereof operatively coupled with the other of said pair.

6. Apparatus in accordance with claim 1, wherein said leaf spring comprises a plurality of individual spring elements disposed in stacked relation with respect to each other to define a multiple leaf spring, said elements being slidable with respect to each other upon deformation of said leaf spring.

7. Apparatus in accordance with claim 1, wherein said spring means comprises a leaf spring having a plurality of individual spring elements disposed on each of two sides of said stop member and in stacked relation with respect to each other to define a pair of multiple leaf springs, an element of one of said multiple leaf springs having a portion thereof extending toward the other of said multiple leaf springs and into force transmitting engagement therewith, so that forces applied to one of said multiple leaf springs are distributed to the other.

8. A soffit plate for use in conjunction with a hydraulic door closer and having a non-directional stop thereon for first resiliently and then non-resiliently limiting movement of a control arm associated with the closer and said soffit plate, said stop comprising a dead stop member affixed to said soffit plate and spring means coupled to said soffit plate adjacent said dead stop member, a pivot point on said soffit plate spaced from said dead stop member and said spring means, said pivot point providing means for pivotably securing the control arm to said soffit plate, said spring means being resiliently deformable and positioned for contact with the control arm when said soffit plate is operatively disposed, said spring means being so positioned with respect to said dead stop member that movement of the control arm is limited by said dead stop member.

9. A soffit plate in accordance with claim 8, wherein said spring means comprises a leaf spring having a plurality of individual spring elements disposed on each of two sides of said dead stop member and in stacked relation with respect to each other to define a pair of multiple leaf springs, an element of one of said multiple leaf springs having a portion thereof extending towards the other of said multiple leaf springs and into forces transmitting engagment therewith, so that forces applied to one of said multiple leaf springs are distributed to the other.

* * * * *